US008581951B2

(12) United States Patent
Fujishiro et al.

(10) Patent No.: US 8,581,951 B2
(45) Date of Patent: Nov. 12, 2013

(54) LIGHT SCANNING APPARATUS, IMAGE FORMING APPARATUS AND COMPUTER READABLE RECORDING MEDIUM

(75) Inventors: Wataru Fujishiro, Anjo (JP); Kazushi Shumiya, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 6 days.

(21) Appl. No.: 13/361,188

(22) Filed: Jan. 30, 2012

(65) Prior Publication Data

US 2012/0195610 A1 Aug. 2, 2012

(30) Foreign Application Priority Data

Jan. 31, 2011 (JP) ..... 2011-018148

(51) Int. Cl.
*B41J 2/435* (2006.01)
*B41J 2/47* (2006.01)

(52) U.S. Cl.
USPC ..... 347/235; 347/229; 347/250

(58) Field of Classification Search
USPC ..... 347/229, 233–235, 248–250
See application file for complete search history.

(56) References Cited

U.S. PATENT DOCUMENTS 4,806,951 A * 2/1989 Arimoto et al. ..... 347/235
5,539,719 A * 7/1996 Motoi ..... 346/107.1
5,966,231 A * 10/1999 Bush et al. ..... 359/204.1
6,005,243 A * 12/1999 Yamazaki ..... 250/234
2001/0009471 A1 7/2001 Ito et al.
2004/0207717 A1 10/2004 Han et al.
2010/0245521 A1 9/2010 Kubo

FOREIGN PATENT DOCUMENTS

JP 10-239606 9/1998
JP A-11-23989 1/1999
JP A-2000-280518 10/2000
JP 2001-075034 3/2001
JP A-2001-197271 7/2001
JP 2003-079184 3/2003
JP 2004-326105 11/2004
JP A-2010-237622 10/2010

OTHER PUBLICATIONS

Notification of Reasons for Refusal dated Dec. 4, 2012 received from the Japanese Patent Office from related Japanese Application No. 2011-018148, together with an English-language translation.

* cited by examiner

*Primary Examiner* — Hai C Pham
(74) *Attorney, Agent, or Firm* — Scully, Scott, Murphy & Presser, P.C.

(57) ABSTRACT

A light scanning apparatus includes: a light emission unit emitting a first light beam and a second light beam; a motor; a rotary polygon mirror rotated by the motor, forming two scanning lines on a scan object at the same time; an optical sensor detecting the first light beam and the second light beam deflected by the rotary polygon mirror; a deviation measurement unit measuring a deviation amount of starting positions of the two scanning lines on the scan object based on a first detection timing at which the optical sensor detects the first light beam and a second detection timing at which the optical sensor detects the second light beam; and a motor control unit controlling rotation of the motor based on the second detection timing in a measurement non-execution period, and controls rotation of the motor without using the first detection timing in a measurement execution period.

13 Claims, 13 Drawing Sheets

1/13

LIGHT SCANNING APPARATUS, IMAGE FORMING APPARATUS AND COMPUTER READABLE RECORDING MEDIUM

CROSS-REFERENCE TO RELATED APPLICATION

This application is based upon and claims the benefit of priority of Japanese Patent Application No. 2011-018148 filed on Jan. 31, 2011, the contents of which are incorporated herein by reference in its entirety.

BACKGROUND

The present disclosure relates to a technology of measuring starting positions of two scanning lines to be simultaneously formed on a photosensitive member.

An image forming apparatus of an electro-photographic type has been known which has a light scanning apparatus that deflects light beams emitted from two light sources by a rotary polygon mirror to form two scanning lines on a photosensitive member at the same time. The light scanning apparatus is provided with a sensor that detects the two light beams. Based on a detection timing at which the sensor detects one light beam, writing timings in a main scanning direction of the two scanning lines are determined.

For example, however, positions of the two light beams incident onto a mirror surface of the rotary polygon mirror are deviated in a rotating direction of the rotary polygon mirror, so that the timings at which the two light beams are illuminated to the photosensitive member may be deviated each other. Regarding this, as described above, in the configuration in which the writing timings of the two scanning lines are determined based on the detection timing of one light beam, the starting positions of the two scanning lines on the photosensitive member are deviated, so that a quality of a formed image may be deteriorated.

Regarding the above problem, a multi-beam laser scanning apparatus has been suggested which alternately lights up two light beams to measure a deviation amount of starting positions of two scanning lines based on a time difference between a detection timing of one beam and a detection timing of the other light beam in a sensor and thus corrects the starting positions of the two scanning lines so as to suppress the deviation amount.

SUMMARY

Many light scanning apparatuses having the rotary polygon mirror feedback control a motor based on an input signal from the sensor so that the detection timing of one light beam in the sensor becomes a constant cycle, thereby rotating the rotary polygon mirror connected to the motor at constant speed. However, in the light scanning apparatus that selectively lights up the two light beams to measure the deviation amount of the starting positions, such as multi-beam laser scanning apparatus, it may be impossible to rotate the rotary polygon mirror at constant speed when measuring the deviation amount. The reason is as follows: according to this light scanning apparatus, when measuring the deviation amount, one light beam that is used to control the rotation of the rotary polygon mirror is temporarily turned off and the other light beam whose detection timing in the sensor is different from that of the one light beam is lighted up. Thereby, an actual rotation cycle of the rotary polygon mirror and a detection cycle of the light beam in the sensor become temporarily different from each other.

An aspect of the disclosure discloses an art which enables the rotary polygon mirror to be normally rotated at constant speed when measuring the deviation amount of the starting positions of the two light scanning lines.

The aspect of the disclosure provides the following arrangements:

A light scanning apparatus comprising:

a light emission unit configured to emit a first light beam and a second light beam;

a motor;

a rotary polygon mirror configured to be rotated by the motor, periodically deflect the first light beam and the second light beam emitted from the light emission unit and form two scanning lines on a scan object;

an optical sensor configured to detect the first light beam and the second light beam deflected by the rotary polygon mirror;

a deviation measurement unit configured to measure a deviation amount of starting positions of the two scanning lines on the scan object in a main scanning direction, based on a first detection timing at which the optical sensor detects the first light beam and a second detection timing at which the optical sensor detects the second light beam; and a motor control unit configured to control rotation of the motor based on the second detection timing in a measurement non-execution period in which the deviation amount is not measured by the deviation measurement unit, and controls rotation of the motor without using the first detection timing that is used to measure the deviation amount, in a measurement execution period in which the deviation amount is measured by the deviation measurement unit.

A non-transitory computer readable recording medium storing a control program enabling a computer, which is provided in a light scanning apparatus comprising a light emission unit configured to emit a first light beam and a second light beam, a motor, a rotary polygon mirror configured to be rotated by the motor, periodically deflect the first light beam and second light beam emitted from the light emission unit and form two scanning lines on an scan object at the same time, and an optical sensor that detects the first light beam and second light beam deflected by the rotary polygon mirror, to execute:

a deviation measurement process of measuring a deviation amount of starting positions of the two scanning lines on the scan object in a main scanning direction, based on a first detection timing at which the optical sensor detects the first light beam and a second detection timing at which the optical sensor detects the second light beam, and a motor control process of controlling rotation of the motor based on the second detection timing, in a measurement non-execution period in which the deviation amount is not measured by the deviation measurement process, and controlling rotation of the motor without using the first detection timing that is used to measure the deviation amount in a measurement execution period in which the deviation amount is measured by the deviation measurement process.

BRIEF DESCRIPTION OF EXEMPLARY EMBODIMENTS

DESCRIPTION OF EXEMPLARY EMBODIMENTS

<First Exemplary Embodiment>

A first exemplary embodiment will be described with reference to FIGS. 1 to 7.

1. Configuration of Laser Printer

Figure 1:
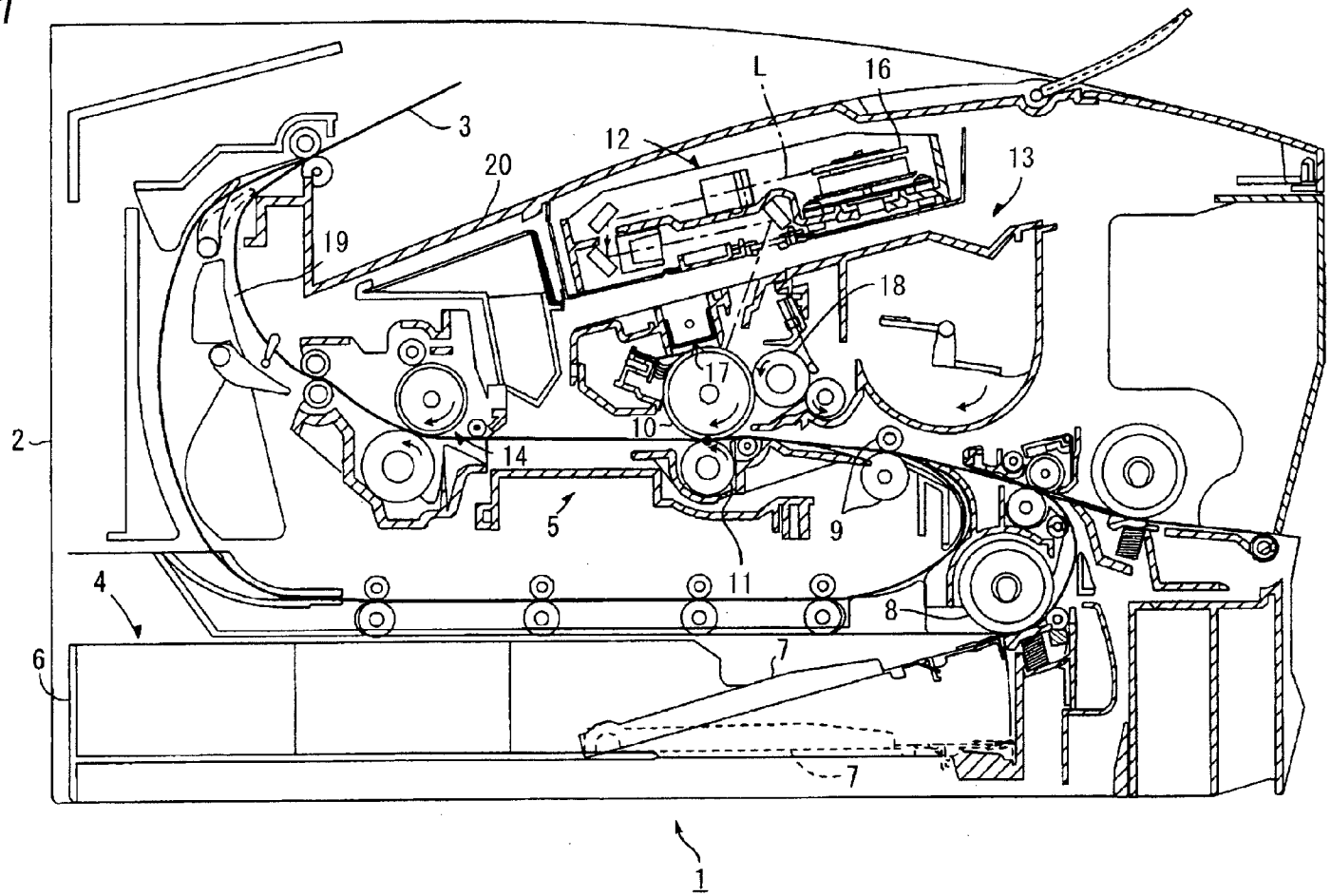
FIG. 1 is a side sectional view showing main parts of a laser printer according to a first exemplary embodiment.

FIG. 1 is a side sectional view showing main parts of a laser printer 1 (which is an example of an image forming apparatus). In the below, a right side of FIG. 1 is referred to as a front of the laser printer 1. The laser printer 1 adopts a so-called multi-beam way of forming two scanning lines on a photosensitive member by laser lights of two lines at the same time. In the meantime, the laser printer 1 may be a monochrome printer or a color printer of two colors or more. In addition to the laser printer, a complex machine having facsimile, copying and reading (scanner) functions may be also possible inasmuch as it has an image forming (printing) function.

The laser printer 1 has, in a main body frame 2, a feeder unit 4 for feeding a sheet 3, an image forming unit 5 for forming an image on the fed sheet 3, and the like.

The feeder unit 4 has a tray 6, a pressing plate 7, a pickup roller 8 and a pair of registration rollers 9, 9. The pressing plate 7 is configured so that it can be rotated about a rear end thereof, and the uppermost sheet 3 on the pressing plate 7 is pressed toward the pickup roller 8. The sheets 3 are picked up one by one by rotation of the pickup roller 8.

The picked up sheet 3 is registered by the registration rollers 9, 9 and is then sent to a transfer position. The transfer position is a position at which a toner image on a photosensitive member 10 is transferred to the sheet 3 and is a contact position of the photosensitive member 10 and a transfer roller 11.

The image forming unit 5 has a scanner unit 12 (which is an example of a light scanning apparatus), a developing unit 13 and a fixing unit 14, for example. The scanner unit 12 has a twin laser 15 (which is an example of a light emitting unit, refer to FIG. 3), a polygon mirror 16 (which is an example of a rotary polygon mirror) and the like. First laser light L1 and second laser light L2 (which are examples of light beams) emitted from the twin laser 15 are periodically deflected by the polygon mirror 16 and are illuminated onto a surface of the photosensitive member 10. The scanner unit 12 will be specifically described in the below.

The developing unit 13 has the photosensitive member 10 (which is an example of a scan object), a scorotron-type charger 17 and a developing roller 18. In the meantime, the photosensitive member 10 is not limited to a drum type and may be a belt type. The charger 17 uniformly and positively charges a surface of the photosensitive member 10. The charged surface of the photosensitive member 10 is exposed by the laser lights L1, L2 emitted from the scanner unit 12, so that an electrostatic latent image is formed thereon. Then, toner carried on a surface of the developing roller 18 is supplied to the electrostatic latent image formed on the photosensitive member 10 and developed, so that a toner image is formed.

The sheet 3 having the toner image formed thereon is conveyed to the fixing unit 14 in which the toner image is heat-fixed. Then, the sheet is discharged onto a sheet discharge tray 20 through a sheet discharge path 19.

2. Electrical Configuration of Laser Printer

Figure 2:
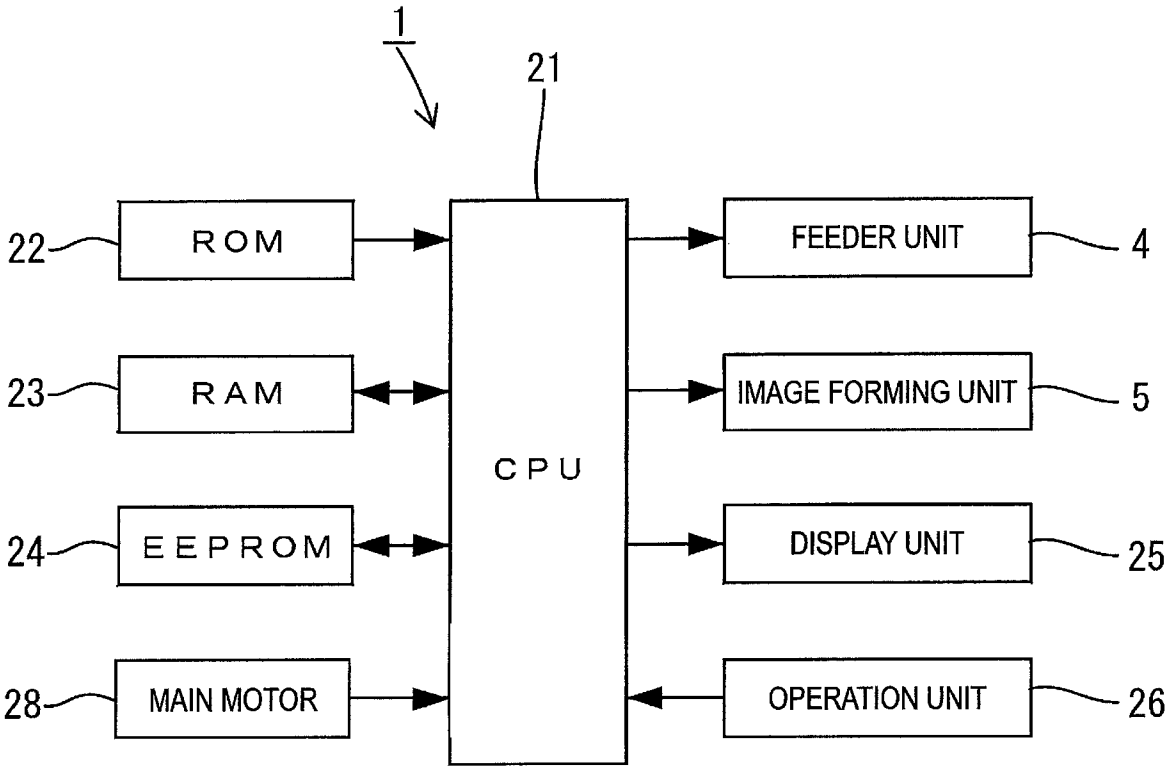
FIG. 2 is a block diagram exemplifying an electrical configuration of a laser printer.

FIG. 2 is a block diagram exemplifying an electrical configuration of the laser printer 1.

The laser printer 1 has a CPU 21, a ROM 22, a RAM 23, an EEPROM 24, the feeder unit 4, the image forming unit 5, a display unit 25 consisting of various lamps, a liquid crystal panel and the like, an operation unit 26 such as input panel, a main motor 28 and the like. In addition, the laser printer has a network interface (not shown) for connection with an external device, and the like. The EEPROM 24 stores therein a control program for executing printing preprocessing that will be described later.

The main motor 28 is a motor for rotating the various conveyance rollers 8, 9 of the feeder unit 4, the photosensitive member 10 and a transfer roller 11, and the like. The main motor is rotated independently of a brushless motor 33 that is provided to the scanner unit 12 (which will be described in the below).

3. Configuration of Scanner Unit

Figure 3:
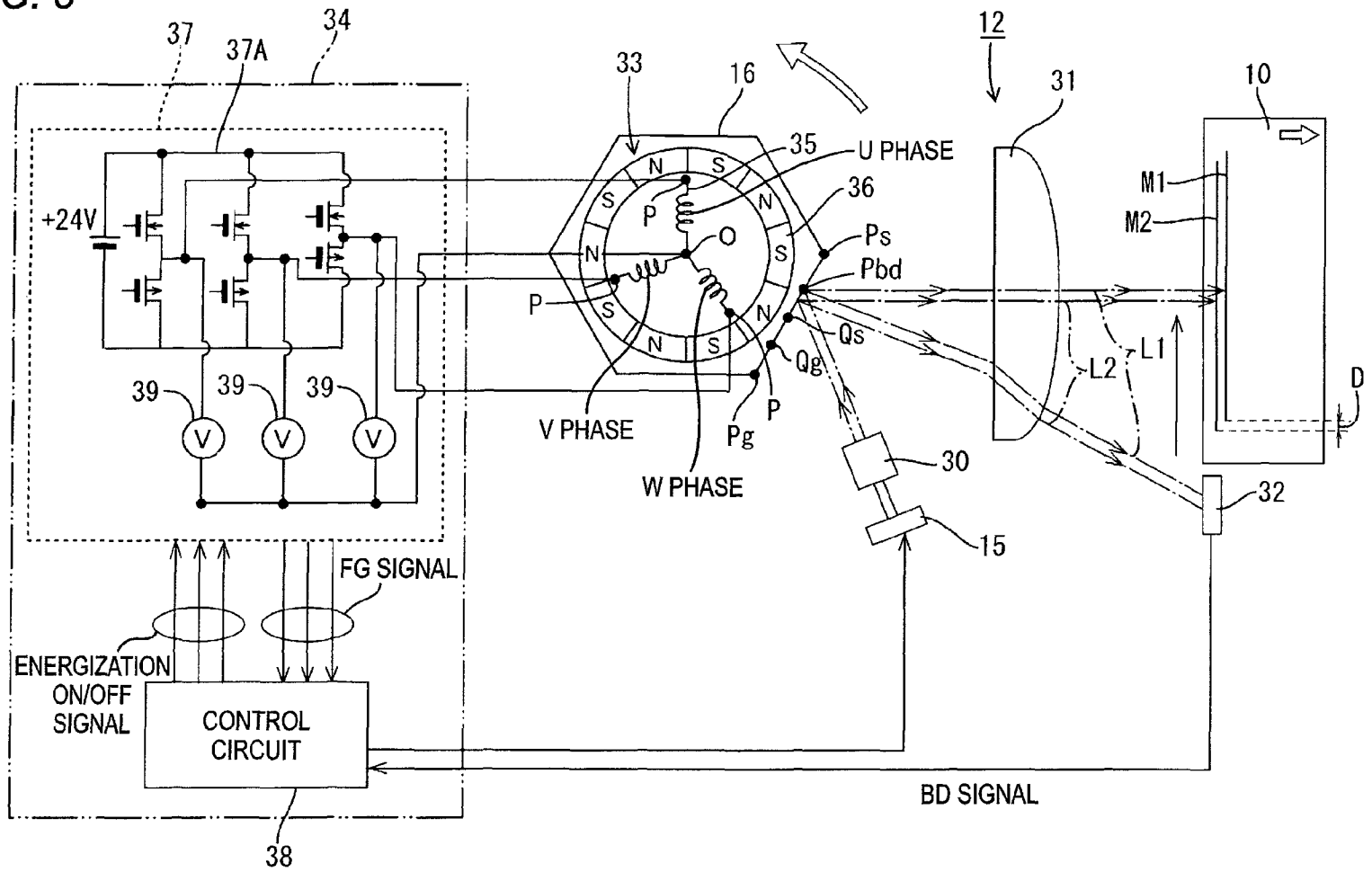
FIG. 3 is a pictorial view showing a configuration of a scanner unit.

FIG. 3 is a pictorial view showing a configuration of the scanner unit 12. The scanner unit 12 has the twin laser 15, a first lens part 30, the polygon mirror 16, a second lens part 31, a light receiving sensor 32 (which is an example of an optical sensor), the brushless motor 33 (which is an example of a motor), a control substrate 34 and the like.

The twin laser 15 has two laser light sources and can emit the first laser light L1 and the second laser light L2 from offset positions. In the meantime, a semiconductor laser can be exemplified as the laser light source. Twin laser 15 may be one chip in which two laser light sources are integrated, or may have separate laser light sources. The first lens part 30 consists of a collimator lens, a cylindrical lens or the like and enables the laser lights L1, L2 emitted from the twin laser 15 to penetrate therethrough, thereby illuminating the same to the polygon mirror 16. The second lens part 31 consists of an fθ lens, a cylindrical lens and the like and enables the laser lights L1, L2 deflected (reflected) at the polygon mirror 16 to penetrate therethrough, thereby illuminating the same onto the photosensitive member 10.

The polygon mirror 16 has six mirror surfaces and is rotated at high speed by the brushless motor 33. In the meantime, the number of the mirror surfaces is not limited to six and may be four, eight and the like. The first laser light L1 and the second laser light L2 emitted from the twin laser 15 are reflected at positions on each mirror surface of the polygon mirror 16, which are deviated in a direction of a rotational shaft of the polygon mirror 16. Therefore, the polygon mirror 16 is rotated at high speed, thereby periodically deflecting the laser lights L1, L2 emitted from the twin laser 15 and forming two scanning lines M1, M2 on the photosensitive member 10 at the same time via the second lens part 31 (refer to FIG. 3). In the meantime, the scanning line M1 is formed by the first laser light L1 and the scanning line M2 is formed by the second laser light L2. The scanning lines M1, M2 are dot-type exposure lines corresponding to each line data of image data. When each line data corresponds to a blank part of an image, a scanning line is not formed.

The brushless motor 33 is a three-phase brushless DC motor, for example, and has a stator 35 having respective coils of U, V and W phases arranged thereto and a rotor 36 having permanent magnets for a magnetic field of ten poles arranged thereto. In the meantime, the number of the permanent magnets for a magnetic field may be arbitrary other than 10 poles. In addition, in the brushless motor 33, the respective coils are arranged by star connection. The polygon mirror 16 is integrally rotated together with the rotor 36.

The control substrate 34 is mounted with a driving circuit 37 that rotates the brushless motor 33, a control circuit 38 (which is an example of a deviation measurement unit, a motor control unit and a position correction unit) and the like. The driving circuit 37 has an inverter 37A (which is an example of an energization switching unit), for example, and turns on and off the energization to the respective coils. The control circuit 38 consists of an ASIC (Application Specific Integrated Circuit), for example, and controls the light emission of the twin laser 15 and the rotation of the brushless motor 33 (polygon mirror 16), based on instructions from the CPU 21.

The light receiving sensor 32 is arranged at a position at which it receives the laser lights L1, L2 deflected at the polygon mirror 16 before the laser lights L1, L2 reach the photosensitive member 10. The light receiving sensor 32 is provided to determine writing timings of the respective scanning lines by the laser lights L1, L2 and receives the laser lights L1, L2 emitted from the twin laser 15 and outputs a beam detect (BD) signal to the control circuit 38 as a detection signal. In the meantime, the light receiving sensor 32 may be arranged at a position at which it receives the laser lights L1, L2 after the laser lights L1, L2 pass through the photosensitive member 10.

4. Configuration for Detecting Position of Rotor

The control circuit 38 can detect a position of the rotor 36 without using a position detection device such as Hall device. That is, the control circuit detects a position of the rotor 36, based on inductive voltages generated in the respective coils as the rotor 36 is rotated relatively to the stator 35.

As the rotor 36 is rotated, the magnet of S pole and the magnet of N pole alternately approach the respective coils, i.e., the respective coils are magnetized. Accompanied by this, magnetic fluxes in the coils are changed, so that inductive voltages are generated in the respective coils. In addition, impedances of the respective coils are different depending on whether the approaching magnet is the S pole or N pole. Accordingly, the inductive voltages show waveforms (for example, sinusoidal waves) in which the voltages are periodically changed at different levels when the S pole and the N pole approach. Thus, by detecting the inductive voltages, it is possible to detect that the magnets of which polarity approach the respective coils, i.e., to detect the position of the rotor 36.

The configuration for detecting the inductive voltages is as follows. As shown in FIG. 3, the driving circuit 37 has three voltage detection circuits 39, 39, 39 (which is an example of a position detection unit) corresponding to the respective coils. Each voltage detection circuit 39 outputs a detection signal corresponding to a voltage difference between an end point P of the corresponding coil and a center point O of the star connection. In the meantime, the end point P is an end portion of the coil connected to the driving circuit 37, and the voltage difference includes the inductive voltage. The driving circuit 37 converts, through a comparator (not shown), each detection signal into a high and low signal whose level is reversed as the inductive voltage is changed, i.e., the polarity of the magnet approaching each coil is switched and provides the same to the control circuit 38. In the below, the high and low signal is referred to as FG signal.

Figure 4:
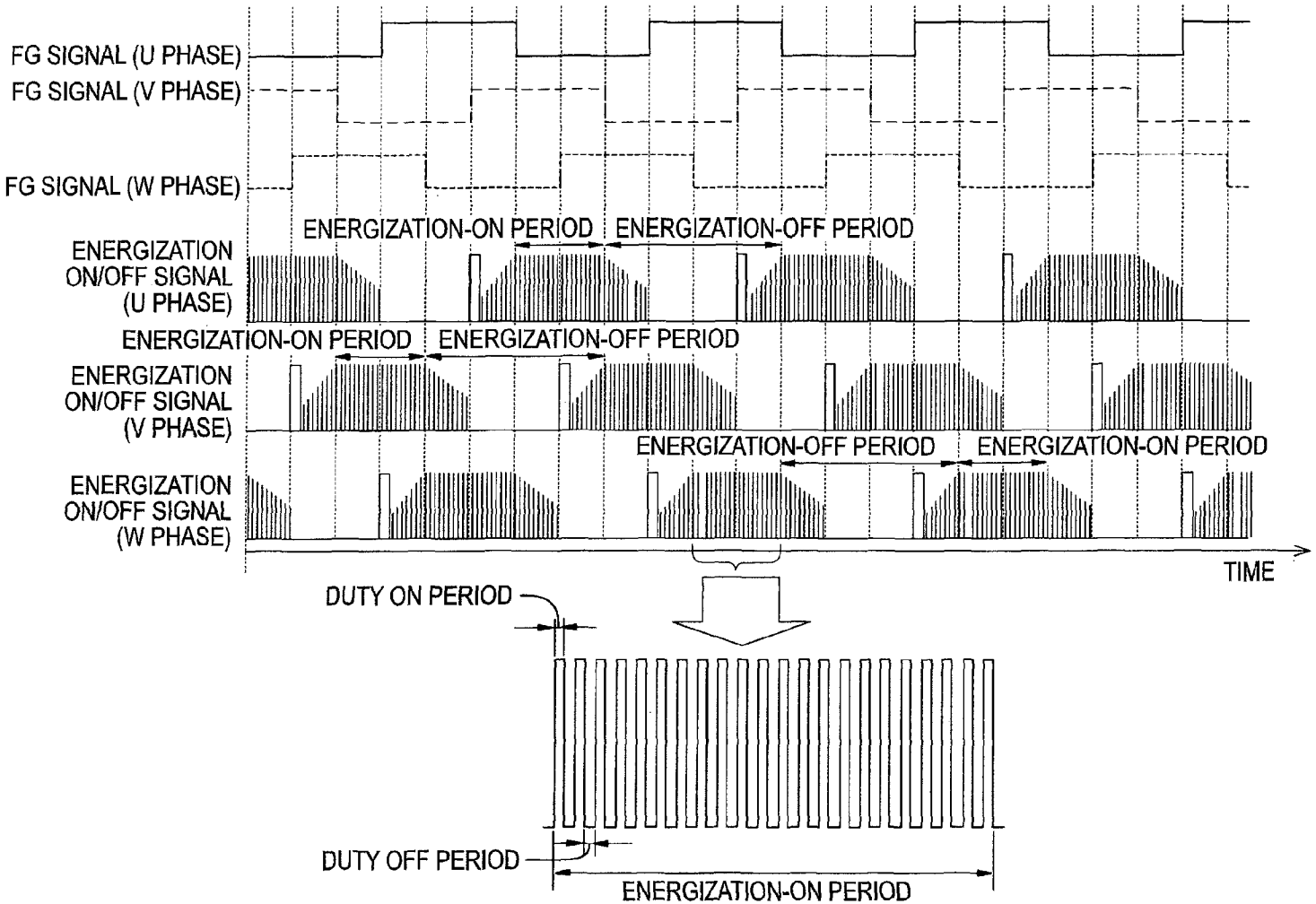
FIG. 4 is a time chart showing waveforms of FG signals and energization on/off signals.

FIG. 4 is a time chart showing waveforms of FG signals and energization on/off signals. As shown in FIG. 4, the FG signals corresponding to the respective phases are provided to the control circuit 39 as waveforms whose phases are offset each other by about 120°. Then, the control circuit 38 provides the driving circuit 37 with energization on/off signals corresponding to the respective FG signals, thereby controlling (chopping controlling) the on and off of energization to the respective coils and thus rotating the brushless motor 33.

An energization-on period (chopping-on period) during which the energization is actively made by executing the chopping control for the coil of each phase is a period of a mountain-shaped on and off waveform shown in FIG. 4, in which an amplitude of a PWM signal is constant. In the meantime, a period of the on and off waveform of each phase in which the amplitude of the PWM signal is gradually increased/decreased is an energization-off period of the corresponding phase and simply indicates a signal level that is generated by the energization to the coils of other phases.

The inductive voltage is detected during a period of the energization-on period in which the energization on/off signal is a low level, for example zero [V]. In the below, a period of the energization-on period in which the energization on/off signal is the low level is referred to as a duty off period and a period in which energization on/off signal is a high level is referred to as a duty on period.

The control circuit 38 may change the rotating speeds of the brushless motor 33 and the polygon mirror 16 by adjusting an energization amount in the energization-on period by a pulse width modulation, for example. Specifically, as shown in FIG. 4, the control circuit 38 changes the PWM value, i.e., a ratio of the duty on period and the duty off period while chopping controlling the inverter 37A on the basis of PWM signals during the energization-on period, thereby changing the rotating speed of the brushless motor 33.

In the meantime, as shown in FIG. 3, the control substrate 34 is arranged at a position spaced from the mount position of the brushless motor 33 (polygon mirror 16), and the control substrate 34 and the brushless motor 33 are connected by only four signal lines that are respectively connected to the end points P of the three coils and the center point P.

5. Printing Preprocessing

Figure 5:
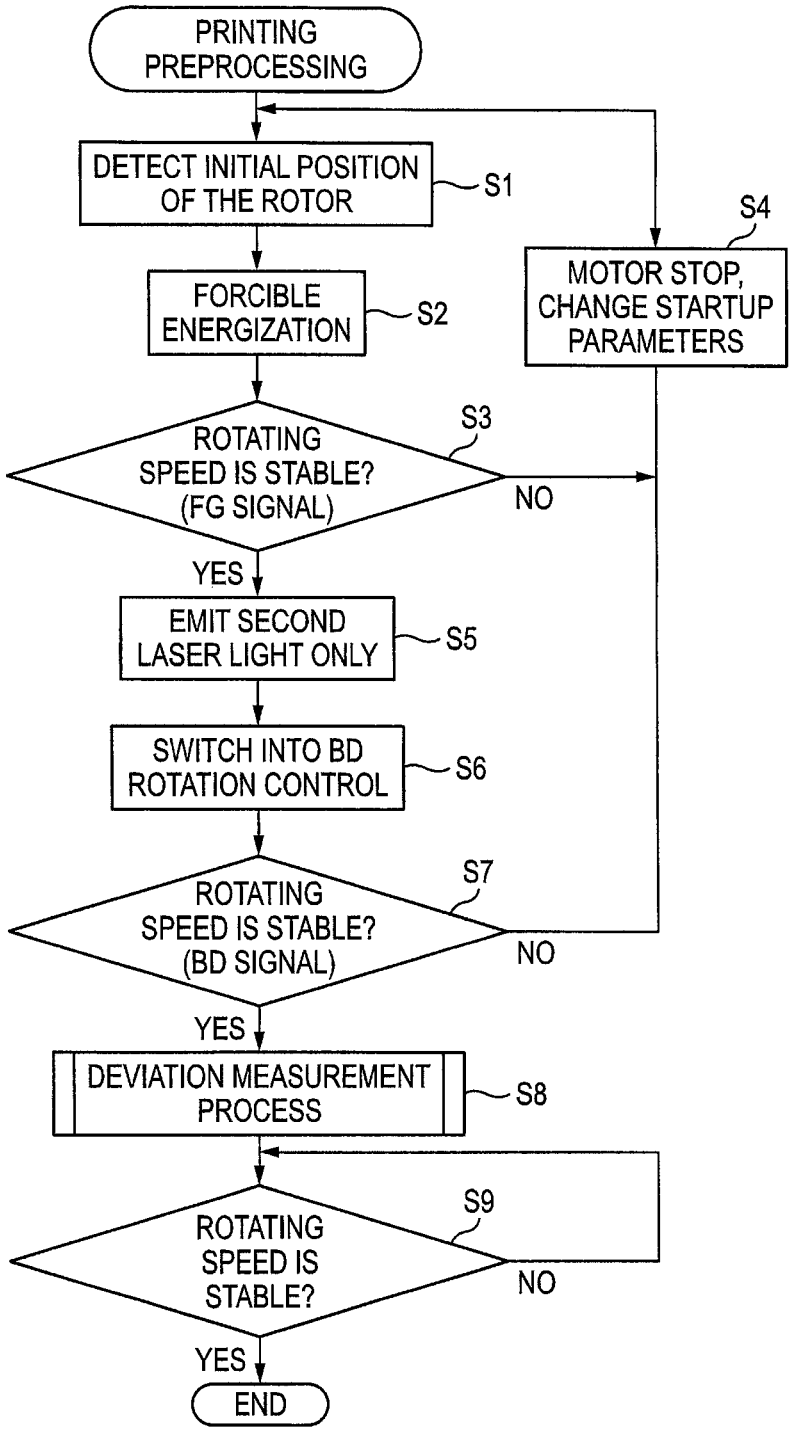
FIG. 5 is a flowchart showing printing preprocessing.
Figure 6:
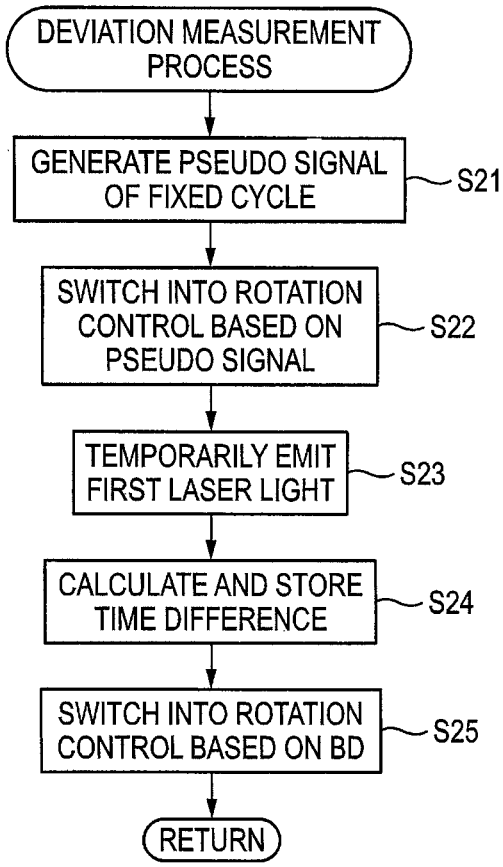
FIG. 6 is a flowchart showing a deviation measurement process.
Figure 7:
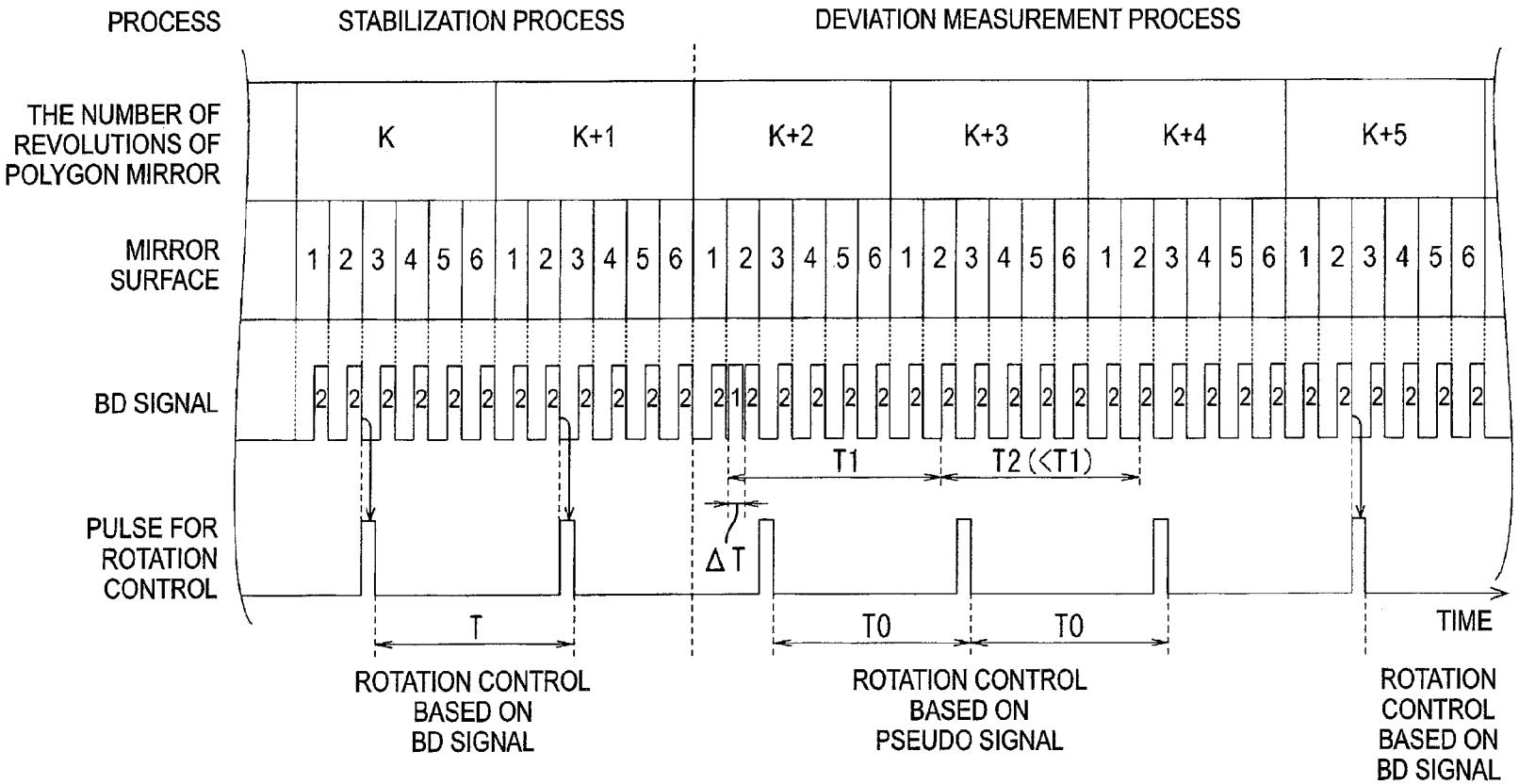
FIG. 7 is a time chart showing a relation of the number of revolutions of a polygon mirror, a BD signal and rotation control.

FIG. 5 is a flowchart showing printing preprocessing, FIG. 6 is a flowchart showing a deviation measurement process and FIG. 7 is a time chart showing a relation of the number of revolutions of a polygon mirror, a BD signal and rotation control. In FIG. 7, the numbers 1 to 6 provided to the time chart of the mirror surface mean sequences of the mirror surfaces to which the laser light L is illuminated when one mirror surface of the polygon mirror 16 is indicated with a forefront 1. The number 1 provided to the time chart of the BD signal means a BD signal that is output when the first laser light L1 is reflected on the mirror surface and the number 2 means a BD signal that is output when the second laser light L2 is reflected on the mirror surface. In the below, the former is referred to as a first BD signal and the latter is referred to as a second BD signal.

For example, when a user performs an input operation for a printing request (printing job) with the operation unit 26 or when an external device (for example, personal computer) (not shown) transmits a printing request (which may include printing data) to the laser printer 1, the CPU 21 transmits, based on the printing request, a rotation starting instruction of the polygon mirror 16 to the control circuit 38. When the rotation starting instruction is received, the control circuit 38 executes printing preprocessing shown in FIG. 5. In the printing preprocessing, a startup process, a stabilization process and a deviation measurement process shown in FIG. 6 are sequentially executed.

(5-1) Startup Process

In the startup process, the control circuit 38 detects an initial position of the rotor 35, i.e., a stop position before the startup (S1). Specifically, the control circuit controls the driving circuit 37 to supply pulse currents to the respective coils, so that the magnetic fluxes in the coils are changed depending on the position of the rotor 36 and the inductances of the coils are changed. Thereby, the control circuit detects the coil voltages that are changed accompanied by the change, thereby detecting the initial position of the rotor 36.

Then, the control circuit 38 executes forcible energization (S2). Specifically, based on the detection result of the initial position, the control circuit 38 sequentially turns on and off the energization to the respective coils by the driving circuit 37, thereby executing the forcible energization. Then, when the rotor 36 starts to rotate, based on the FG signals, the inductive voltages generated in the respective coils are reflected in the FG signals. Accordingly, it is possible to detect the position of the rotor 36 and the rotating speed of the rotor 36, based on the FG signals.

Then, the control circuit 38 reads out the FG signals in the duty off period of the energization-on period, provides the PWM signal to the driving circuit 37 to control the on and off of the energization to the respective coils and executes the rotating speed control based on the FG signals, thereby trying a full-fledged startup of the brushless motor 33. In the meantime, the FG signal is generated by a part of the signal detected from the inductive voltages. The phase switching timing is determined based on the inductive voltages (U, V, W) and the rotating speed of the brushless motor 33 (rotor 36) is controlled by the FG signal that is generated from the inductive voltage (U), for example.

When the brushless motor reaches the number of revolutions with which the inductive voltages can be detected, the control circuit 38 determines whether the rotating speed of the brushless motor 33 is stable by the rotating speed control based on the FG signals (S3). Specifically, the control circuit detects the rotation cycle of the brushless motor 33, i.e., the rotating speed, based on the on/off cycle of at least one signal (in this exemplary embodiment, one FG signal) of the three FG signals and determines whether the detected rotation cycle is within a predetermined target range.

When the detected rotation cycle is beyond the target range, the control circuit determines that the rotating speed is unstable (S3: NO). For example, when the initial position of the rotor 36 is erroneously detected in S3, after the forcible energization in S5, the brushless motor 33 is not normally rotated and the rotating speed thereof is unstable, so that the startup may fail. In this case, the brushless motor 33 is stopped. At this time, preferably, a reverse current is supplied or both terminals of the brushless motor 33 are shorted to apply a brake (short brake) to the brushless motor 33, so that when the inductive voltage is not detected, the brake is released. Thereby, it is possible to rapidly stop the brushless motor 33 and to thus cope with the retry.

Subsequently, the control circuit changes a part or all of startup parameters (frequency of the energization on/off signal, motor advancing angle, PWM value (motor current value)) (S4) and returns to S1 to try the re-startup of the brushless motor 33. For example, the control circuit increases the frequency of the energization on/off signal or motor advancing angle (makes the timing of predicted energization fast) or increases the PWM value to increase the startup current, thereby enabling the brushless motor 33 to start more easily.

When the detected rotation cycle is within the target range, the control circuit determines that the rotating speed is stable (S3: YES) and proceeds to the stabilization process.

(5-2) Stabilization Process

In the stabilization process, the control circuit 38 enables the twin laser 15 to emit only the second laser light L2 (S5). At this time, the emission of the second laser light L2 is stopped in a period during which each mirror surface of the polygon mirror 16 faces a direction along which the second laser light L2 is illuminated onto the photosensitive member 10. Thereby, the light receiving sensor 32 periodically receives the laser lights L1, L2 deflected on the polygon mirror 16 and outputs the second BD signal depending on the light receiving timing Like this, the control circuit enables the twin laser 15 to emit the lights, on condition that the rotating speed of the brushless motor 33 is stabilized (S3: YES). Therefore, it is possible to suppress the laser lights L1, L2, which are generated from the twin laser 15, from being illuminated to the photosensitive member 10 and thus damaging the same even when an error is caused with respect to the rotation control.

Then, the control circuit 38 switches into a rotation control based on the second BD signal from the rotation control based on the FG signal, which has been executed in the startup process (S6). The rotation control based on the second BD signal is a feedback control that the control circuit 38 feeds back the second BD signal from the light receiving sensor 32 and thus adjusts the PWM value of the PWM signal so that the output cycle of the second BD signal, i.e., the detection cycle of the second laser light L2 is within the target range.

Specifically, for a case where the number of revolutions of the polygon mirror shown in FIG. 7 is K or K+1, for example, the control circuit 38 generates a pulse for rotation control synchronously with a descending edge (which is an example of a second detection timing) of the pulse wave of the second BD signal and adjusts the PWM value of the PWM signal so that a generation cycle T of the pulse for rotation control is within the target range. In this exemplary embodiment, as shown in FIG. 7, the control circuit 38 performs the rotation control, based on only the second BD signal corresponding to the second laser light L2 that is reflected on the same mirror surface of the six surfaces of the polygon mirror 16 every one revolution. In FIG. 7, the same mirror surface is the second mirror surface.

It may be possible to use the BD signals corresponding to the second laser lights L2 reflected on the different surfaces. However, in this exemplary embodiment, it is possible to improve the detection accuracy of the rotation cycle of the polygon mirror 16 by suppressing influences caused due to arrangement non-uniformity of the surfaces and the like. The control circuit 38 may determine whether the second BD signal corresponds to the same mirror surface by counting the generation number of the second BD signals.

Subsequently, the control circuit 38 determines whether the rotating speed of the brushless motor 33 is stable or not (S7). Specifically, the control circuit determines whether the generation cycle T of the pulse for rotation control is within the target range. When the generation cycle T is beyond the target range, the control circuit determines that the rotating speed is unstable (S7: NO) and returns to S4. On the other hand, when the generation cycle T is within the target range, the control circuit determines that the rotating speed is stable (S7: YES) and proceeds to the deviation measurement process (S8). The control circuit may determine whether the rotating speed of the brushless motor 33 is stable or not by determining whether the generation cycle T continues to be within the target range for a predetermined cycle. In the meantime, the time to execute the stabilization process is an example of a measurement non-execution period.

(5-3) Deviation Measurement Process

First, the deviation of the starting positions of the two scanning lines M1, M2 in the main scanning direction is described.

As shown in FIG. 3, the first laser light L1 and the second laser light L2 emitted from the twin laser 15 may be reflected at positions, which are deviated in the rotational direction of the polygon mirror 16 shown with an outline arrow of FIG. 3, on each mirror surface of the polygon mirror 16. This is caused because the physical positions of the two laser light sources are different or the optical system such as first lens part 30 is deviated, for example.

Therefore, the second laser light L2 is detected in the light receiving sensor 32 later than the first laser light L1 and is illuminated onto the photosensitive member 10 later than the first laser light L1. Here, in printing processing that is executed after the printing preprocessing, only the second laser light L2 is emitted in a period before the scanning to the photosensitive member 10 and writing timings of the two scanning lines by the first laser light L1 and the second laser light L2 at the scanning time are determined from the detection timing of the second BD signal from the light receiving sensor 32. Accordingly, when the writing timings of the first laser light L1 and the second laser light L2 are determined after the same time elapses from the detection timing of the second BD signal, the starting positions of the two scanning lines on the photosensitive member 10 are deviated in the main scanning direction by a deviation amount D, as shown in FIG. 3, so that a quality of a printed image may be deteriorated.

Regarding the above problem, the control circuit 38 executes the deviation measurement process shown in FIG. 6. At this time, the control circuit 38 functions as a deviation measurement unit and a motor control unit. The control circuit 38 first reads out a fixed cycle T0 (which is an example of a predetermined rotation cycle) pre-stored in the RAM 23 or EEPROM 24 (which is an example of a memory) and generates a pseudo signal with the fixed cycle T0 (S21). Meanwhile, in the stabilization process, the control circuit 38 prestores, as the fixed cycle T0, the actual generation cycle T in the RAM 23 and the like. Accordingly, during the deviation measurement process, it is possible to perform the rotation control while reflecting the actual generation cycle T recently acquired.

Then, the control circuit 38 stops the rotation control based on the BD signal and switches into the rotation control of the polygon mirror 16, based on the pseudo signal (S22). Specifically, the control circuit 38 provides a motor control circuit (not shown) in the control circuit 38 with the pseudo signal of the fixed cycle T0, instead of the pulse for rotation control. Thereby, the rotation of the polygon mirror 16 is controlled with the fixed cycle T0 without being influenced by the BD signal.

The control circuit 38 controls the first laser light L1 to be temporarily emitted (S23). In the meantime, FIG. 7 shows an example in which the first laser light L1 is emitted only to the second mirror surface whose the number of revolutions of the polygon mirror is K+2 and the first BD signal is thus output. However, the first laser light L1 may be emitted to the first and third mirror surfaces and the like other than the second mirror surface. When emitting the first laser light L1, it is preferable to turn off the second laser light L2. This is to distinguish the first BD signal and the second BD signal.

Then, the control circuit 38 calculates first time T1 between an ascending edge (which is an example of a first detection timing) of the first BD signal for the second mirror surface at the $K+2^{th}$ revolution and an ascending edge of the second BD signal for the second mirror surface at the $K+3^{th}$ revolution. The control circuit calculates second time T2 between the ascending edges of the second BD signal for the second mirror surface at the $K+3^{th}$ and $K+4^{th}$ revolutions. A time difference ΔT (=T1−T2) between the first time T1 and the second time T2 corresponds to the deviation amount of the stating positions of the two scanning lines M1, M2 in the main scanning direction. In the meantime, the second time T2 may be calculated based on the second BD signal at the revolution earlier than the $K+2^{th}$ revolution, for example at the time of stabilization process.

The control circuit 38 stores the time difference ΔT in the RAM 23 or EEPROM 24 as the deviation amount (S24), stops the generation of the pseudo signal and again switches into the rotation control based on the BD signal (S25), as shown in the $K+5^{th}$ revolution of FIG. 7, and thus ends the deviation measurement process and returns to S9 of FIG. 5. Meanwhile, in the deviation measurement process, the time from the $K+2^{th}$ revolution to the $K+4^{th}$ revolution is an example of a measurement execution period.

Then, the control circuit 38 determines whether the rotating speed of the brushless motor 33 is stable, like S7. When it is determined that the rotating speed is stable (S9: YES), the control circuit ends the printing preprocessing and proceeds to the printing processing. In the meantime, the period after the deviation measurement process is an example of the measurement non-execution period. In the printing processing, the control circuit 38 changes a time difference between the writing timing of the first laser light L1 and the writing timing of the second laser light L2 so as to offset the time difference ΔT. At this time, the control circuit 38 functions as the position correction unit.

Specifically, when it is assumed that the writing timing of the second laser light L2 is a timing after predetermined time elapses from the detection timing of the second BD signal, the writing timing of the first laser light L1 is a timing after time corresponding to the predetermined time and time difference ΔT elapses from the detection timing of the second BD signal. Thereby, it is possible to substantially match the starting positions of the two scanning lines M1, M2 by the first laser light L1 and the second laser light L2 in the main scanning direction.

6. Effects of this Exemplary Embodiment

According to this exemplary embodiment, during the measurement non-execution period in which the deviation amount of the starting positions of the two scanning lines M1, M2 on the photosensitive member 10 is not measured, the rotation of the brushless motor 33 is controlled based on the second detection timing, i.e., the generation timing of the second BD signal, and during the measurement execution period in which the deviation amount is measured, the rotation of the brushless motor 33 is controlled without using the first detection timing that is used to measure the deviation amount, i.e., the first BD signal. Accordingly, when measuring the deviation amount, the rotation of the brushless motor 33 is controlled without being influenced by the first detection timing that is used to measure the deviation amount.

Specifically, during the measurement non-execution period, the rotation of the brushless motor 33 is controlled based on the second detection timing, and during the measurement execution period, the rotation of the brushless motor 33 is controlled with the predetermined rotation cycle regardless of the first detection timing and the second detection timing, i.e., regardless of the generation of the BD signal. Therefore, when measuring the deviation amount, the rotation of the brushless motor 33 is controlled without being influenced by the first detection timing that is used to measure the deviation amount. Thus, it is possible to suppress that the polygon mirror 16 cannot be normally rotated at constant speed when measuring the deviation amount of the starting positions of the two light scanning lines M1, M2.

The rotation cycle of the brushless motor 65 in the measurement non-execution period is stored in the RAM 23 and the like, and in the measurement execution period, the rotation cycle stored in the RAM 23 and the like is used as the predetermined rotation cycle to control the rotation of the brushless motor 33. Accordingly, compared to a configuration in which the rotation cycle in the measurement execution period is determined regardless of the rotation cycle in the measurement non-execution period, it is possible to control the rotation of the motor based on the actually measured value of the rotation cycle in the measurement execution period.

<Second Exemplary Embodiment>

Figure 8:
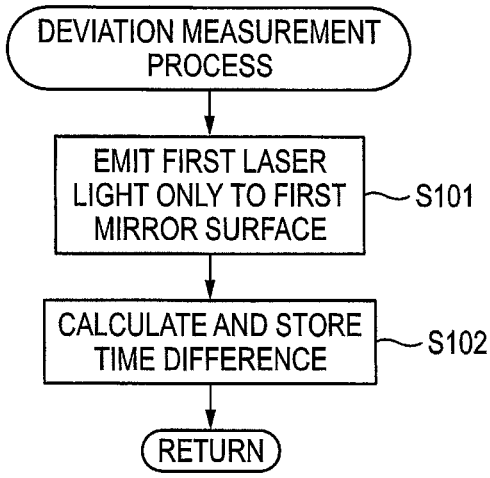
FIG. 8 is a flowchart showing a deviation measurement process of a second exemplary embodiment.
Figure 9:
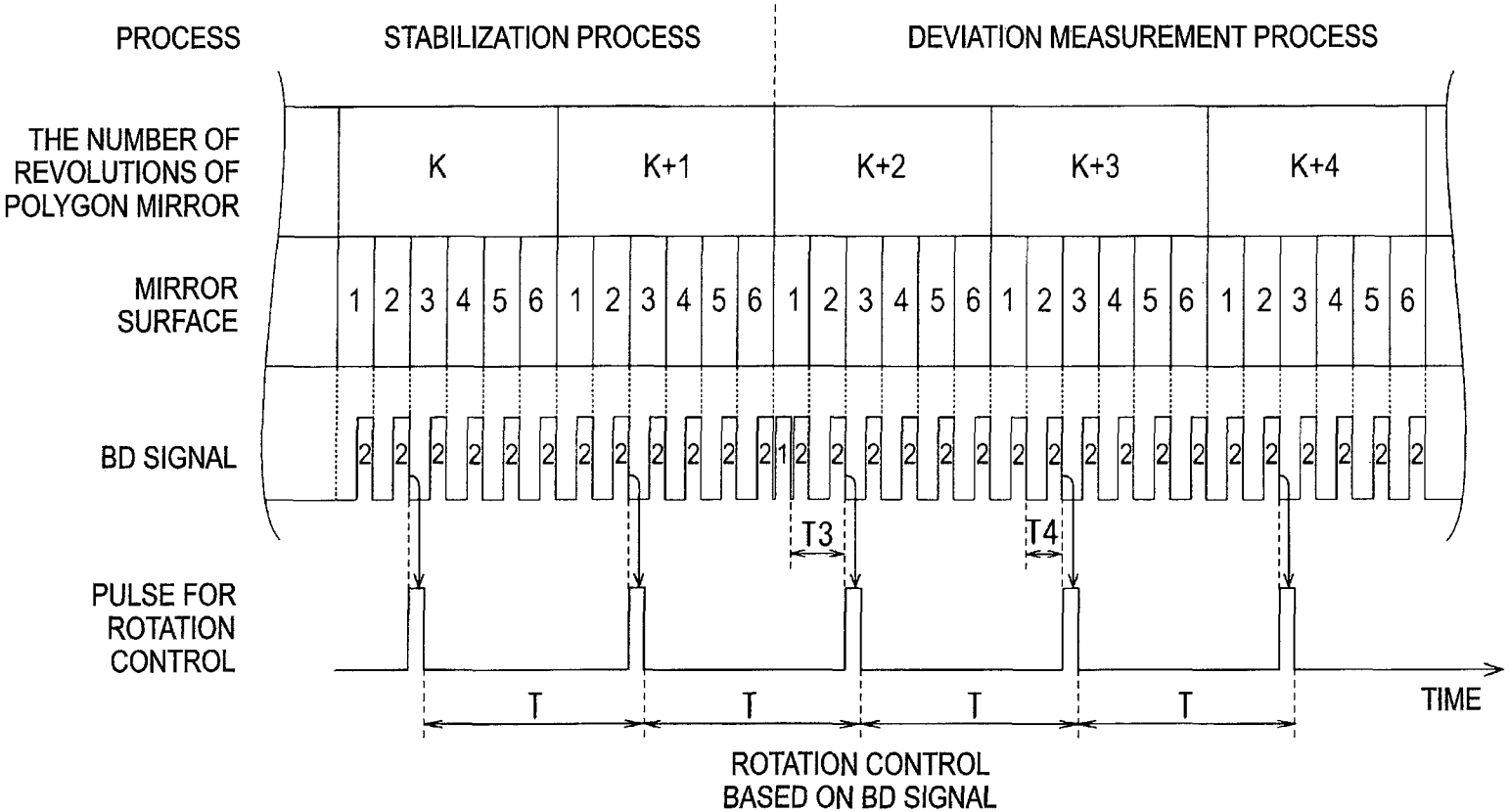
FIG. 9 is a time chart showing a relation of the number of revolutions of a polygon mirror, a BD signal and rotation control.

FIGS. 8 and 9 show a second exemplary embodiment. The second exemplary embodiment is different from the first exemplary embodiment in the deviation measurement process and the others are the same as the first exemplary embodiment. Accordingly, the same constitutional elements are indicated with the same reference numerals as the first exemplary embodiment and the descriptions thereof are omitted. In the below, only the differences are described.

1. Deviation Measurement Process

In this exemplary embodiment, the control circuit 38 executes the deviation measurement process shown in FIG. 8 after the stabilization process. At this time, the control circuit 38 functions as the deviation measurement unit and the motor control unit. As shown in FIG. 9, the control circuit 38 continues the rotation control of the brushless motor 33, based on the second BD signal corresponding to the second mirror surface, like the stabilization process. Then, the control circuit 38 enables the first laser light L1 to be temporarily emitted only to the first mirror surface (which is an example of one mirror surface) at the $K+2^{th}$ revolution (which is an example of the one rotation cycle) (S101). In the meantime, when emitting the first laser light L1, it is preferable to turn off the second laser light L2. This is to distinguish the first BD signal and the second BD signal.

Then, the control circuit 38 calculates third time T3 between a descending edge of the first BD signal for the first mirror surface at the $K+2^{th}$ revolution and a descending edge of the second BD signal for the second mirror surface (which is an example of another mirror surface) at the $K+2^{th}$ revolution. The control circuit calculates fourth time T4 between the descending edges of the second BD signal for the first and second mirror surfaces at the $K+3^{th}$ revolution (which is an example of another rotation cycle). A time difference ΔT (=T3−T4) between the third time T3 and the fourth time T4 corresponds to the deviation amount of the stating positions of the two scanning lines M1, M2 in the main scanning direction. In the meantime, the fourth time T4 may be calculated based on the second BD signal at the revolution earlier than the $K+2^{th}$ revolution, for example at the time of stabilization process.

The control circuit 38 stores the time difference ΔT in the RAM 23 or EEPROM 24 as the deviation amount (S102), ends the deviation measurement process and returns to S9 of FIG. 5. Meanwhile, in the deviation measurement process, the time at least from the $K+2^{th}$ revolution to the $K+3^{th}$ revolution is an example of the measurement execution period.

2. Effects of this Exemplary Embodiment

According to this exemplary embodiment, the deviation amount is measured based on the time difference ΔT between the third time T3 and the fourth time T4. The rotation of the brushless motor 33 is controlled based on the second detection timing corresponding to the second mirror surface, i.e., the generation timing of the second BD signal in the measurement non-execution period as well as in the measurement execution period. That is, although the first and second mirror surfaces are used in measuring the deviation amount, the first mirror surface to which the first laser light L1 is illuminated is not used and only the second mirror surface to which the second laser light L2 is illuminated is used in controlling the rotation of the brushless motor 33. Accordingly, when measuring the deviation amount, the rotation of the brushless motor 33 is controlled without being influenced by the first BD signal that is used for the measurement. Therefore, when measuring the deviation amount of the starting positions of the two light scanning lines, it is possible to suppress that the polygon mirror 16 cannot be normally rotated at constant speed.

The first laser light L1 may be illuminated only to the first, third and fifth mirror surfaces and the second laser light L2 may be illuminated only to the second, fourth and sixth mirror surfaces, and average values of the third time and the fourth time may be calculated based on the illuminations of the laser lights. At this time, when the first laser light L1 is illuminated only to the one mirror surface, like this exemplary embodiment, it is possible to suppress the measurement accuracy of the deviation amount from being lowered due to the position deviation between the mirror surfaces of the polygon mirror 16. When the rotation of the polygon mirror 16 is controlled based on only the second BD signal corresponding to one mirror surface, it is possible to suppress the accuracy of the rotation control from being lowered due to the position deviation between the mirror surfaces.

<Third Exemplary Embodiment>

Figure 10:
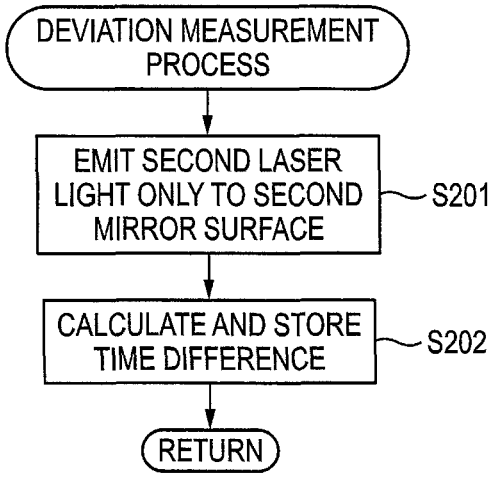
FIG. 10 is a flowchart showing a deviation measurement process of a third exemplary embodiment.
Figure 11:
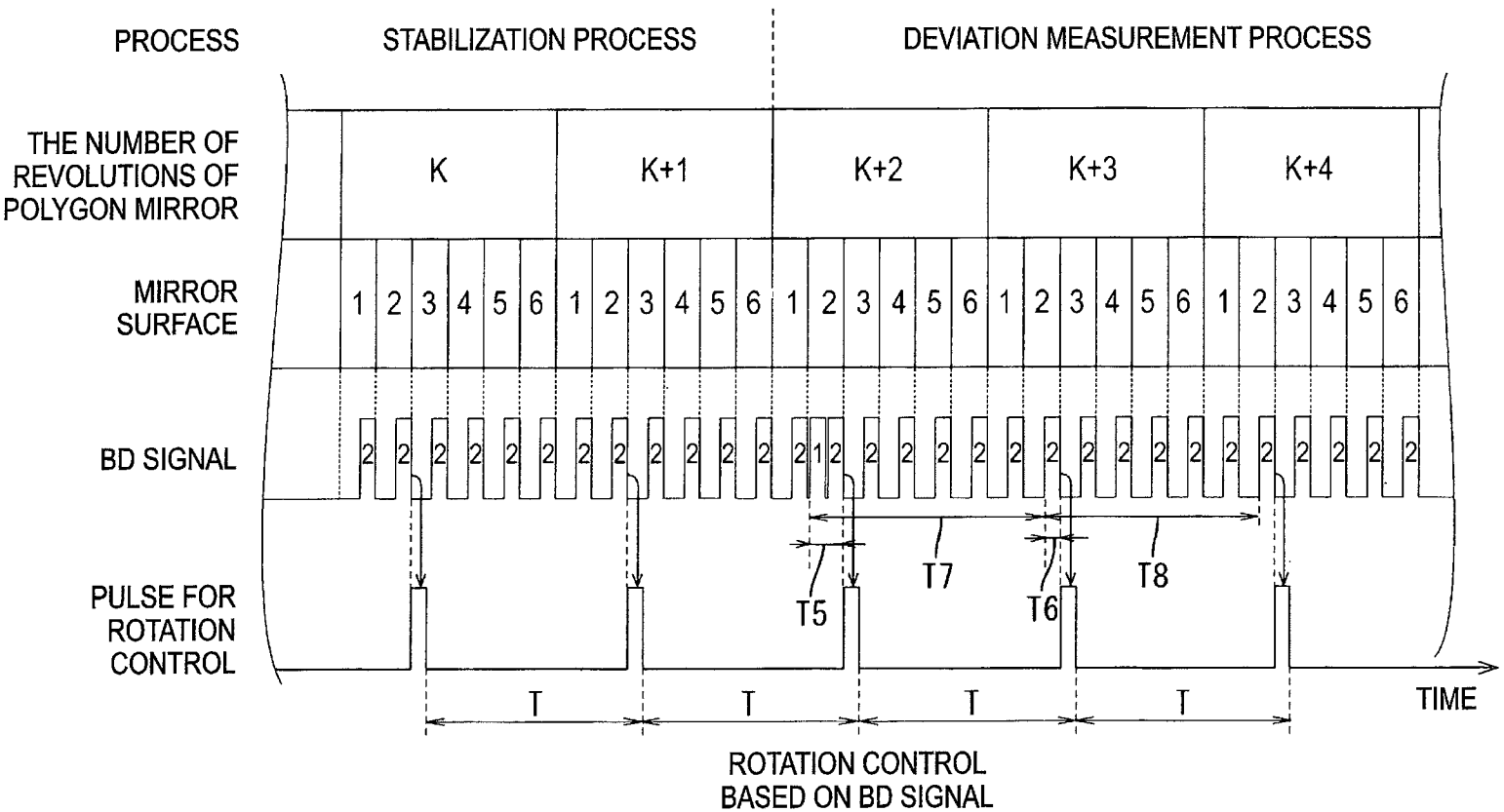
FIG. 11 is a time chart showing a relation of the number of revolutions of a polygon mirror, a BD signal and rotation control.

FIGS. 10 and 11 show a third exemplary embodiment. The third exemplary embodiment is different from the first exemplary embodiment in the deviation measurement process and the others are the same as the first exemplary embodiment. Accordingly, the same constitutional elements are indicated with the same reference numerals as the first exemplary embodiment and the descriptions thereof are omitted. In the below, only the differences are described.

1. Deviation Measurement Process

In this exemplary embodiment, the control circuit 38 executes the deviation measurement process shown in FIG. 10 after the stabilization process. At this time, the control circuit 38 functions as the deviation measurement unit and the motor control unit. As shown in FIG. 11, the control circuit 38 continues the rotation control of the brushless motor 33, based on the descending edge (which is an example of a period far from the detection period of the first light beam) of the second BD signal corresponding to the second mirror surface, like the stabilization process. Then, the control circuit 38 enables the first laser light L1 to be temporarily emitted only to the first mirror surface (which is an example of one mirror surface) at the K+2$^{th}$ revolution (S201). Accordingly, the first laser light L1 and the second laser light L2 are illuminated onto the first mirror surface.

Then, the control circuit 38 calculates fifth time T5 between an ascending edge (which is an example of a detection start period of an light beam detected earlier) of the first BD signal for the second mirror surface at the K+2$^{th}$ revolution and a descending edge (which is an example of a detection end time of a light beam detected later) of the second BD signal. The control circuit calculates sixth time T6 between the ascending and descending edges (which are examples of the detection start time and detection end time of the second light beam) of the second BD signal for the second mirror surface at the K+3$^{th}$ revolution. A time difference ΔT (=T5−T6) between the fifth time T5 and the sixth time T6 corresponds to the deviation amount of the stating positions of the two scanning lines M1, M2 in the main scanning direction. In the meantime, the sixth time T6 may be calculated based on the second BD signal at the revolution earlier than the K+2$^{th}$ revolution, for example at the time of stabilization process.

The control circuit 38 stores the time difference ΔT in the RAM 23 or EEPROM 24 as the deviation amount (S202), ends the deviation measurement process and returns to S9 of FIG. 5. Meanwhile, in the deviation measurement process, the time at least from the K+2$^{th}$ revolution to the K+3$^{th}$ revolution is an example of the measurement execution period.

2. Effects of this Exemplary Embodiment

According to this exemplary embodiment, the deviation amount is measured based on the time difference ΔT between the fifth time T5 and the sixth time T6. In the measurement non-execution period, the rotation of the brushless motor 33 is controlled based on the period far from the detection period of the first laser light L1 of the detection start time and the detection end time of the second laser light L2, in FIG. 11, based on the period different from the detection period of the first laser light L1. That is, although the detection timings of the first laser light L1 and the second laser light L2 are used in measuring the deviation amount, only the detection timing of the second laser light L2 is used in controlling the rotation of the brushless motor 33. Accordingly, when measuring the deviation amount, the rotation of the brushless motor 33 is controlled without being influenced by the detection timing of the first laser light L1 that is used for the measurement. Therefore, when measuring the deviation amount of the starting positions of the two light scanning lines, it is possible to suppress that the polygon mirror 16 cannot be normally rotated at constant speed.

<Fourth Exemplary Embodiment>

Figure 12:
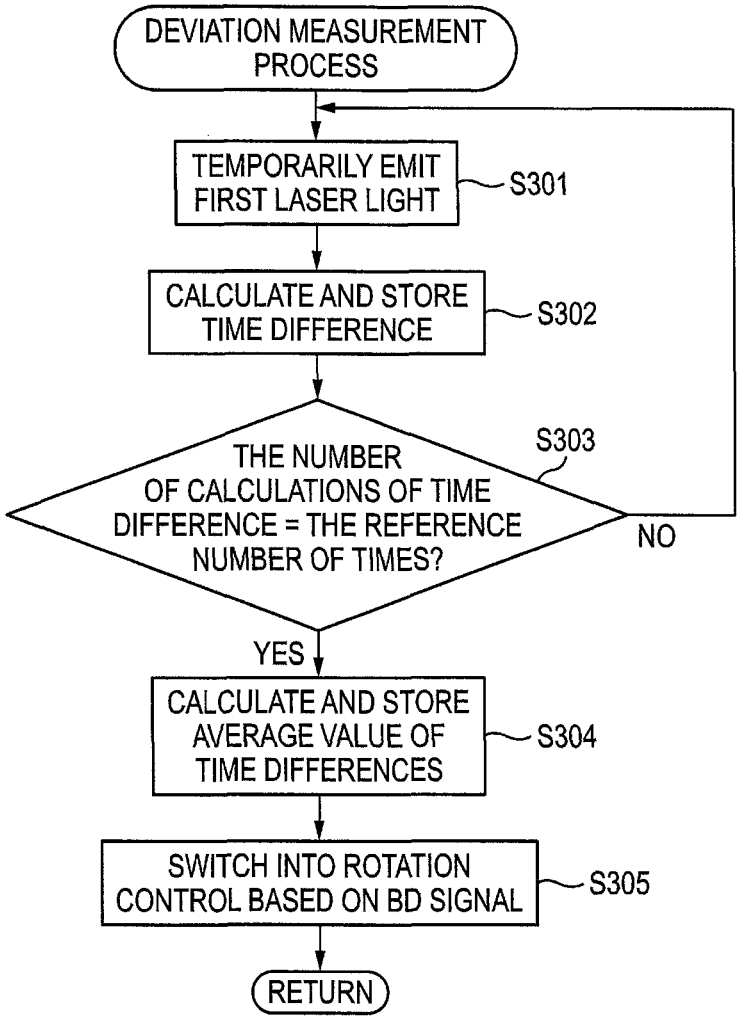
FIG. 12 is a flowchart showing a deviation measurement process of a fourth exemplary embodiment.
Figure 13:
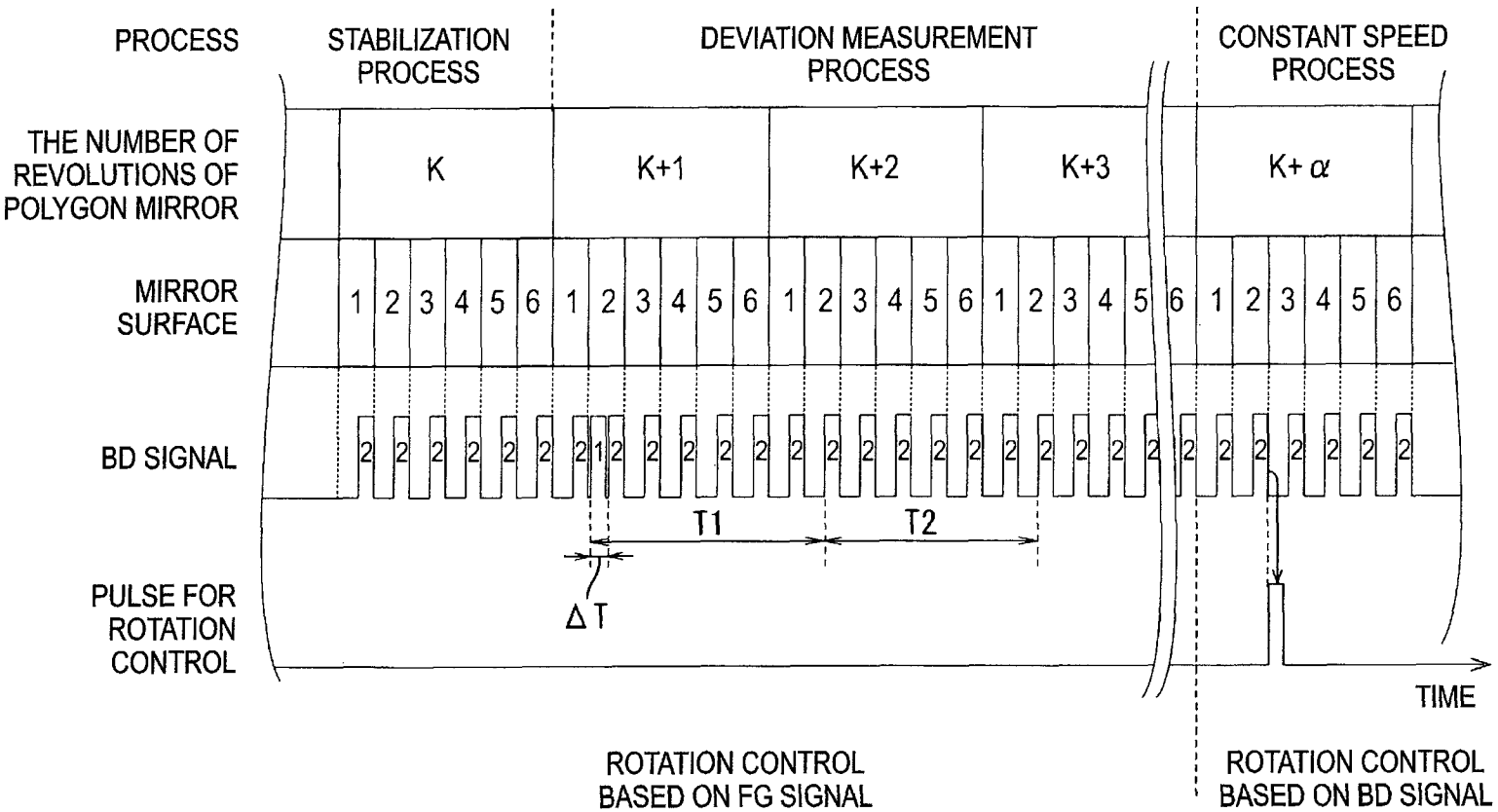
FIG. 13 is a time chart showing a relation of the number of revolutions of a polygon mirror, a BD signal and rotation control.

FIGS. 12 and 13 show a fourth exemplary embodiment. The fourth exemplary embodiment is different from the first exemplary embodiment in a part of the stabilization process and in the deviation measurement process and the others are the same as the first exemplary embodiment. Accordingly, the same constitutional elements are indicated with the same reference numerals as the first exemplary embodiment and the descriptions thereof are omitted. In the below, only the differences are described.

1. Stabilization Process and Deviation Measurement Process

In this exemplary embodiment, the control circuit 38 does not execute S6 of FIG. 5 in the stabilization process. That is, as shown in FIG. 13, the control circuit proceeds to the deviation measurement process while continuing the rotation control based on the FG signal. Then, the control circuit 38 executes the deviation measurement process shown in FIG. 12. At this time, the control circuit 38 functions as the deviation measurement unit and the motor control unit.

The control circuit 38 enables the first laser light L1 to be temporarily emitted (S301), like S23 and S24 of FIG. 6 and calculates and stores the time difference ΔT in the RAM 23 and the like (S302). Then, when the control circuit 38 repeatedly calculates the time difference ΔT by the reference number of times (for example, five times) (S303: YES), the control circuit calculates and stores an average value of the time differences ΔT of the reference number of times in the RAM 23 and the like (S304). Then, the control circuit 38 switches from the rotation control based on the FG signal to the rotation control based on the BD signal (S305, refer to FIG. 13), ends the deviation measurement process and returns to S9 of FIG. 5.

2. Effects of this Exemplary Embodiment

According to this exemplary embodiment, in the measurement non-execution period, the rotation of the brushless motor 33 is controlled based on the FG signal, rather than the second detection timing. That is, although the BD signal is used in measuring the deviation amount, only the FG signal is used in controlling the rotation of the brushless motor 33. Accordingly, when measuring the deviation amount, the rotation of the brushless motor 33 is controlled without being influenced by the BD signal. Therefore, when measuring the deviation amount of the starting positions of the two light scanning lines, it is possible to suppress that the polygon mirror 16 cannot be normally rotated at constant speed.

The rotation control based on the FG signal may have the lower control accuracy than the rotation control based on the BD signal. Accordingly, like this exemplary embodiment, it is preferable to calculate the time difference ΔT plural times and to store the average value of the time differences ΔT measured plural times in the RAM 23 and the like.

<Other Exemplary Embodiments>

The invention is not limited to the above descriptions and the exemplary embodiments described with reference to the drawings. For example, following aspects are also included in the technical scope of the invention.

(1) In the above exemplary embodiments, the scanner unit 12 has been used to expose the photosensitive member 10 of the laser printer 1. However, for example, the same configuration as the scanner unit may be provided to a laser processing apparatus so as to laser process an object to be processed (which is an example of the scan object). For instance, any light scanning apparatus may be possible inasmuch as it forms two scanning lines on an scan object at the same time. A configuration may be also possible in which the position correction unit for suppressing the deviation amount is not provided and information based on a measured value, such as error information that is issued when a measured value of the deviation amount exceeds a predetermined value, is notified to the outside.

(2) In the above exemplary embodiments, the brushless motor 33 of a sensorless type has been exemplified as the motor for rotating the polygon mirror. However, a brushless motor including a sensor having a Hall device or motor having a brush may be also possible. Since the detection accuracy of the rotation position of the brushless motor 33 of a sensorless type is not so much high, it is particularly useful to apply the exemplary embodiment to the brushless motor. The brushless motor of the above exemplary embodiments adopts the three phases, the outer rotor type and the start connection. However, the invention is not limited thereto. That is, two phases or four or more phases are also possible. An inner rotor type and a delta connection are also possible. In the meantime, for the delta connection, it is possible to obtain a detection signal corresponding to an inductive voltage, based on a voltage between terminals of the respective coils, for example.

(3) In the above exemplary embodiments, the printing preprocessing has been executed when the laser printer 1 receives the printing request. However, the same control process as the printing preprocessing may be executed after the printing or while waiting for the printing request. That is, the corresponding process may be executed in a non-printing period in which a printing job is not executed.

(4) In the above exemplary embodiments, the fixed cycle T0 may be stored in the memory embedded in the control circuit 38 or a memory that is provided to the outside of the laser printer 1.

(5) In the above exemplary embodiments, the ascending or descending edge of the BD signal has been used as the detection timing of the laser light. However, the ascending edge, the descending edge of the BD signal and a timing between both edges may be used as the detection timing. However, when the first BD signal and the second BD signal come close to each other, it is preferable to use an edge opposite to the other BD signal as the detection timing.

(6) In the second exemplary embodiment, the first mirror surface and the second mirror surface have been used. However, two mirror surfaces other than the first and second mirror surfaces may be used.

(7) In the third exemplary embodiment, the first laser light L1 and the second laser light L2 have been illuminated to the second mirror surface. However, the first laser light L1 and the second laser light L2 may be illuminated to a surface other than the second mirror surface. The first laser light L1 and the second laser light L2 may be illuminated to a plurality of mirror surfaces in one rotation cycle. At this time, when the first laser light L1 and the second laser light L2 are illuminated to only one surface in one rotation cycle, like the third exemplary embodiment, it is possible to suppress the measurement accuracy of the deviation amount from being lowered due to the position deviation between the mirror surfaces of the polygon mirror 16.

The mirror surface that is used to calculate the fifth time T5 and the mirror surface that is used to calculate the sixth time T6 may be different from each other. However, when the same mirror surface is used, like the third exemplary embodiment, it is possible to suppress the measurement accuracy of the deviation amount from being lowered due to the position deviation between the mirror surfaces of the polygon mirror 16.

(8) In the third exemplary embodiment, the first BD signal and the second BD signal have been sequentially output from the light receiving sensor 32. However, the second BD signal and the first BD signal may be sequentially output from the light receiving sensor 32. In this case, it is preferable that time between the ascending edge of the second BD signal and the descending edge of the first BD signal is calculated as the fifth time and the rotation of the brushless motor 33 is controlled based on the ascending edge of the second BD signal.

(9) In the third exemplary embodiment, the measurement of the deviation amount and the rotation control of the brushless motor 33 may be performed as follows. That is, as shown in FIG. 11, the control circuit 38 calculates seventh time T7 between the ascending edge (which is an example of the detection start period of the first light beam) of the first BD signal corresponding to the second mirror surface at the $K+2^{th}$ revolution and the ascending edge (which is an example of the detection start period of the second light beam) of the second BD signal corresponding to the second mirror surface at the $K+3^{th}$ revolution. The control circuit 38 calculates eighth time T8 between the ascending edge of the second BD signal corresponding to the second mirror surface at the $K+3^{th}$ revolution and the ascending edge of the second BD signal corresponding to the second mirror surface at the $K+4^{th}$ revolution and measures the deviation amount based on a time difference ΔT between the seventh time T7 and the eighth time T8.

In the meantime, during the measurement of the deviation amount, the control circuit 38 controls the rotation of the brushless motor 33, based on the descending edge (which is an example of the detection end time of the second light beam) of the second BD signal corresponding to the second mirror surface. That is, although the detection timings of the first laser light L1 and the second laser light L2 are used in measuring the deviation amount, only the detection timing of the second laser light L2 is used in controlling the rotation of the brushless motor 33. Accordingly, when measuring the deviation amount, the rotation of the brushless motor 33 is controlled without being influenced by the detection timing of the first laser light L1 that is used for the measurement. Therefore, when measuring the deviation amount of the starting positions of the two light scanning lines, it is possible to suppress that the rotary polygon mirror cannot be normally rotated at constant speed.

In the meantime, a following control is performed in the configuration in which the light receiving sensor 32 sequentially receives the second laser light L2 and the first laser light L1. That is, the control circuit 38 calculates seventh time T7 between the descending edge (which is an example of the detection end time of the first light beam) of the first BD signal corresponding to the second mirror surface at the $K+2^{th}$ revolution and the descending edge (which is an example of the detection end time of the second light beam) of the second BD signal corresponding to the second mirror surface at the $K+3^{th}$ revolution. The control circuit 38 calculates eighth time T8 between the descending edge of the second BD signal corresponding to the second mirror surface at the $K+3^{th}$ revolution and the descending edge of the second BD signal corresponding to the second mirror surface at the $K+4^{th}$ revolution and measures the deviation amount based on a time difference ΔT between the seventh time T7 and the eighth time T8.

In the meantime, during the deviation measurement process, the control circuit 38 controls the rotation of the brushless motor 33, based on the ascending edge (which is an example of the detection start time of the second light beam) of the second BD signal corresponding to the second mirror surface. This configuration also achieves the same effects as the above configurations.

(10) In the above exemplary embodiments, the control circuit 38 executes all the printing preprocessing. However, the invention is not limited thereto. For example, different control circuits may execute the respective processes or each step of the respective processes. In the meantime, the control circuit is not limited to the ASIC and may be configured by a universal hardware circuit or a calculation device (CPU) and a memory device.

What is claimed is:

1. A light scanning apparatus comprising:

a light emission unit configured to emit a first light beam and a second light beam;

a motor;

a rotary polygon mirror configured to be rotated by the motor, periodically deflect the first light beam and the second light beam emitted from the light emission unit and form two scanning lines on a scan object;

an optical sensor configured to detect the first light beam and the second light beam deflected by the rotary polygon mirror;

a deviation measurement unit configured to measure a deviation amount of starting positions of the two scanning lines on the scan object in a main scanning direction, based on a first detection timing at which the optical sensor detects the first light beam and a second detection timing at which the optical sensor detects the second light beam; and a motor control unit configured to control rotation of the motor based on the second detection timing in a measurement non-execution period in which the deviation amount is not measured by the deviation measurement unit, and controls rotation of the motor without using the first detection timing that is used to measure the deviation amount, in a measurement execution period in which the deviation amount is measured by the deviation measurement unit.

2. The light scanning apparatus according to claim 1, wherein the deviation measurement unit measures the deviation amount, based on a time difference between first time between the first detection timing and the second detection timing, and second time between the second detection timings, and the motor control unit controls the rotation of the motor with a predetermined rotation cycle regardless of the first detection timing and the second detection timing, in the measurement execution period.

3. The light scanning apparatus according to claim 2, wherein the motor control unit stores a rotation cycle of the motor in the measurement non-execution period in a memory and controls the rotation of the motor in the measurement execution period by using the rotation cycle stored in the memory as the predetermined rotation cycle.

4. The light scanning apparatus according to claim 2, wherein the deviation measurement unit measures the deviation amount plural times and sets an average value of the deviation amounts measured plural times as a final deviation amount.

5. The light scanning apparatus according to claim 1, wherein the deviation measurement unit measures the deviation amount, based on a time difference between third time between a first detection timing at which the first light beam is reflected on one mirror surface of the rotary polygon mirror and a second detection timing at which the second light beam is reflected on another mirror surface in one rotation cycle of the motor, and fourth time between the second detection timings at which the second light beam is reflected on the one mirror surface and another mirror surface in another rotation cycle of the motor, and the motor control unit controls the rotation of the motor in the measurement non-execution period, based on the second detection timing at which the second light beam is reflected on said another mirror surface.

6. The light scanning apparatus according to claim 5, wherein said one mirror surface is a single surface.

7. The light scanning apparatus according to claim 1, wherein the deviation measurement unit measures the deviation amount, based on a time difference between fifth time and sixth time, the fifth time is time between a detection start time of the light beam which is detected earlier of the first light beam and the second light beams which are reflected on one mirror surface of the rotary polygon mirror, the sixth time is time between a detection start time of the light beam which is detected later of the second light beams which are reflected on said one surface or another mirror surface of the rotary polygon mirror, and the motor control unit controls the rotation of the motor in the measurement non-execution period, based on one of the detection start time and the detection end time which is farther from the detection period of the first light beam.

8. The light scanning apparatus according to claim 1, wherein the optical sensor is configured to sequentially detect the first light beam and the second light beam in this order, the deviation measurement unit measures the deviation amount, based on a time difference between seventh time and eighth time, the seventh time is time between a detection start time of the first light beam when the first light beam and the second light beams are reflected on one mirror surface of the rotary polygon mirror and a detection start time of the second light beam when the second light beam is reflected on said one mirror surface or another mirror surface of the rotary polygon mirror, the eighth time is time between detection start times of the second light beam when the second light beams are reflected on the one surface or another mirror surface, and the motor control unit controls the rotation of the motor in the measurement non-execution period, based on a detection end time of the second light beam.

9. The light scanning apparatus according to claim 1, wherein the optical sensor is configured to sequentially detect the second light beam and the first light beam in this order, the deviation measurement unit measures the deviation amount, based on a time difference between seventh time and eighth time, the seventh time is time between a detection start time of the first light beam when the first light beam and the second light beams are reflected on one mirror surface of the rotary polygon mirror and a detection start time of the second light beam when the second light beam is reflected on said one mirror surface or another mirror surface of the rotary polygon mirror, the eighth time is time between detection start times of the second light beam when the second light beams are reflected on the one surface or another mirror surface, and the motor control unit controls the rotation of the motor in the measurement non-execution period, based on a detection start time of the second light beam.

10. The light scanning apparatus according to claim 1, wherein the motor is a brushless motor including a stator having a plurality of coils and a rotor having a magnet, the light scanning apparatus further comprises:

an energization switching unit configured to turn on and off energization to the respective coils, and a position detection unit configured to output a detection signal corresponding to a rotation position of the rotor, the motor control unit controls the rotation of the brushless motor, based on the second detection timing, thus turns on and off the energization by the energization switching unit based on the detection signal, performs chopping control on the energization switching unit in an energization-on period, controls the rotation of the brushless motor so that the rotation of the brushless motor approximates a target value by changing a duty ratio in the chopping control, and controls the rotation of the motor based on the detection signal in the measurement non-execution period.

11. The light scanning apparatus according to claim 1 further comprising a position correction unit configured to change a time difference of light emission timings of the first light beam and the second light beam when forming the two scanning lines, based on the deviation amount measured by the deviation measurement unit, thereby reducing the deviation amount.

12. An image forming apparatus comprising:

the light scanning apparatus according to claim 1, and a photosensitive member serving as the scan object, wherein an image is formed on an image forming medium based on an electrostatic latent image formed on the photosensitive member by the light scanning apparatus.

13. A non-transitory computer readable recording medium storing a control program enabling a computer, which is provided in a light scanning apparatus comprising a light emission unit configured to emit a first light beam and a second light beam, a motor, a rotary polygon mirror configured to be rotated by the motor, periodically deflect the first light beam and second light beam emitted from the light emission unit and form two scanning lines on an scan object at the same time, and an optical sensor that detects the first light beam and second light beam deflected by the rotary polygon mirror, to execute:

a deviation measurement process of measuring a deviation amount of starting positions of the two scanning lines on the scan object in a main scanning direction, based on a first detection timing at which the optical sensor detects the first light beam and a second detection timing at which the optical sensor detects the second light beam, and a motor control process of controlling rotation of the motor based on the second detection timing, in a measurement non-execution period in which the deviation amount is not measured by the deviation measurement process, and controlling rotation of the motor without using the first detection timing that is used to measure the deviation amount in a measurement execution period in which the deviation amount is measured by the deviation measurement process.

* * * * *